US005085573A

United States Patent [19]

Geary

[11] Patent Number: 5,085,573

[45] Date of Patent: * Feb. 4, 1992

[54] HOT SURFACE IGNITION SYSTEM FOR A GAS FURNACE, CONTROL DEVICE THEREFOR AND METHODS OF MAKING THE SAME

[75] Inventor: Frederick J. Geary, Holland, Mich.

[73] Assignee: Robertshaw Controls Company, Richmond, Va.

[ * ] Notice: The portion of the term of this patent subsequent to Dec. 11, 2007 has been disclaimed.

[21] Appl. No.: 591,551

[22] Filed: Oct. 1, 1990

Related U.S. Application Data

[62] Division of Ser. No. 356,871, May 24, 1989, Pat. No. 4,976,605.

[51] Int. Cl.[5] ..... F23N 5/00

[52] U.S. Cl. ..... 431/6; 431/27; 431/69; 431/70

[58] Field of Search ..... 431/6, 27, 86, 69, 70

[56] References Cited

U.S. PATENT DOCUMENTS

| | | | |
|---|---|---|---|
| 3,447,880 | 6/1969 | Potts et al. | 431/27 |
| 3,975,136 | 8/1976 | Baysinger et al. | 431/27 |
| 4,459,099 | 7/1984 | Grunden et al. | 431/27 |
| 4,643,668 | 2/1987 | Geary | 431/70 |
| 4,695,246 | 9/1987 | Beilfoss et al. | 431/31 |
| 4,711,628 | 12/1987 | Geary | 431/31 |
| 4,746,284 | 5/1988 | Geary | 431/70 |
| 4,976,605 | 12/1990 | Geary | 431/27 |

*Primary Examiner*—Carl D. Price

*Attorney, Agent, or Firm*—Candor, Candor & Tassone

[57] ABSTRACT

A hot surface ignition system for a gas furnace or the like, control device therefor and methods of making the same are provided, the system comprising a burner, a settable thermostat, an electrically operable gas valve, a control unit, and an electrically operable hot surface igniter disposed so as to be in the path of gas issuing from the burner that is adapted to be fed the gas from a source thereof through the gas valve when the control unit has been activated by the thermostat to operate the igniter and the gas valve in a certain sequence, the control unit having a lockout unit for deactivating the system should ignition of the gas issuing from the burner not take place by the end of the certain sequence, the control unit having a resetting unit for causing the control unit to be reactivated to be adapted to repeat the certain sequence of the system when the resetting unit is activated, the control unit being adapted to select the certain sequence to have one or more attempts of the control unit to ignite the gas at the burner before the lockout unit can deactivate the system, the resetting unit comprising a manually operated electrical switch that is remote from the thermostat and which must be manually moved to a certain position thereof to activate the resetting unit.

6 Claims, 6 Drawing Sheets

120 VAC
IGNITOR
THERMOSTAT
GAS VALVE
REMOTE SENSE
E1 (TH)
E2 (VALVE)
E3 (TR)
E4 (RS)
E5 (L1)
E6 (I1)
C1 .0068 630V
R1 390K
R2 910 2W
R3 10M
RT1
K1
K2
K3
K4
W1
S1
D17 1N4004
D18
D19
D20
D21
D22
D23
R29 2.2K
R30 2.2K
RED
GRN
050-00266-01
J1-1
J1-2
J1-3
J1-4
J1-5

| CODE | NOT AVAILABLE FOR MANUAL RESET | | BASIC 34 SECOND TIME | |
|---|---|---|---|---|
| | | | NON PREPURGE INSERT | PREPURGE INSERT |
| N/P | | | R9,R12,Q4 | W2 |
| LOC | | | W1 | W1 |
| 1 TRY | | | D5,D6 | D4,D5 |
| 2 TRYS | | | D3,D5 | D3,D5 |
| 3 TRYS | | | D3,D4 | D3,D4,D6 |
| | 4 SECONDS | 6 SECONDS | 8 SECONDS | 12 SECONDS |
| R10 | 45.3K 1% | 68.1K 1% | 90.9K 1% | 140K 1% |
| R20 | 20K 2% | 39K 2% | 61.9K 1% | 140K 1% |
| | INSERT | | | |
| B=220V | W4,Q10,C12,R25,R26,R27,R28,D16,Z3,Z4,U2,RT2,W8 | | | |

FIG. 4

HOT SURFACE IGNITION SYSTEM FOR A GAS FURNACE, CONTROL DEVICE THEREFOR AND METHODS OF MAKING THE SAME

CROSS REFERENCE TO RELATED APPLICATION

This application is a divisional patent application of its copending parent patent application, Ser. No. 356,871, fled May 24, 1989, now U.S. Pat. No. 4,976,605.

BACKGROUND OF THE INVENTION

1. Field of the Invention

This invention relates to a new hot surface ignition system for a gas furnace or the like, a control device therefor and to new methods of making such a system and such a control device.

2. Prior Art Statement

It is known to provide a hot surface ignition system for a gas furnace or the like, the system comprising a burner means, a settable thermostat means, an electrically operable gas valve, control means, and an electrically operable hot surface igniter means disposed so as to be in the path of gas issuing from the burner means that is adapted to be fed the gas from a source thereof through the gas valve when the control means has been activated by the thermostat means to operate the igniter means and the gas valve in a certain sequence, the control means having lockout means for deactivating the system should ignition of the gas issuing from the burner means not take place by the end of the certain sequence, the control means having resetting means for causing the control means to be reactivated to be adapted to repeat the certain sequence of the system when the resetting means is activated, the control means having means for selecting the certain sequence to have one or more attempts of the control means to ignite the gas at the burner means before the lockout means can deactivate the system. For example, see the U.S. Pat. No. to Geary, 4,643,668, and the U.S. Pat. No. to Geary, 4,711,628, wherein the resetting means comprises the thermostat means.

It is also known to provide a hot surface ignition system which has a control means that will deactivate the system should ignition of the gas issuing from the burner means not take place at the end of the first attempt to ignite the gas at the burner means so that a manually operated electrical switch that is remote from the thermostat means must be manually moved to a certain position thereof to reactivate the control means before another attempt can be made to ignite gas issuing from the burner means.

SUMMARY OF THE INVENTION

It is one feature of this invention to provide a new hot surface ignition system for a gas burner or the like wherein a unique resetting means is provided that requires a manually operated electrical switch means that is remote from the thermostat means to be manually moved to a certain position thereof to reactivate the control means to be adapted to attempt ignition of gas issuing from the burner means after a lockout means of the control means has deactivated the system because ignition of the gas issuing from the burner means did not take place at the end of a certain sequence that could have included one or more attempts of the control means to ignite the gas at the burner means.

As previously stated, the prior known hot surface ignition systems of the U.S. Pat. Nos. to Geary, 4,643,668 and 4,711,628, each permit the control means to be reactivated after a lockout condition existed by the operator merely opening the thermostat means and thereafter closing the same.

However, it was found that it is desirable to have a manually operable electrical switch means that is remote from the thermostat means that must be manually moved to a certain position thereof before the control means can be reactivated after a lockout condition with that control means still having means for selecting the certain sequence of operation thereof to have one or more attempts of the control means to ignite the gas at the burner means before the lockout means can deactivate the system.

For example, one embodiment of this invention provides a hot surface ignition system for a gas furnace or the like, the system comprising a burner means, a settable thermostat means, an electrically operable hot surface igniter means so as to be disposed in the path of the gas issuing from the burner means that is adapted to be fed the gas from a source thereof through the gas valve when the control means has been activated by the thermostat means to operate the igniter means and the gas valve in a certain sequence, the control means having lockout means for deactivating the system should ignition of the gas issuing from the burner means not take place by the end of the certain sequence, the control means having resetting means for causing the control means to be reactivated to be adapted to repeat the certain sequence of the system when the resetting means is activated, the control means having means for selecting the certain sequence to have one or more attempts of the control means to ignite the gas at the burner means before the lockout means can deactivate the system, the resetting means comprising a manually operated electrical switch means that is remote from the thermostat means and which must be manually moved to a certain position thereof to activate the resetting means.

Accordingly, it is an object of this invention to provide a new hot surface ignition system for a gas furnace or the like, the system of this invention having one or more of the novel features of this invention as set forth above or hereinafter shown or described.

Another object of this invention is to provide a new control device for such a system, the control device of this invention having one or more of the novel features of this invention as set forth above or hereinafter shown or described.

Another object of this invention is to provide new methods of making such a hot surface ignition system for a gas furnace or the like and such a control device, the methods of this invention each having one or more of the novel features of this invention as set forth above or hereinafter shown or described.

Other objects, uses and advantages of this invention are apparent from a reading of this description which proceeds with reference to the accompanying drawings forming a part thereof and wherein:

BRIEF DESCRIPTION OF THE DRAWINGS

FIG. 3A illustrates part of the hot surface ignition system and the control device of this invention.

FIG. 4 is a table or chart illustrating how the hot surface ignition system and the control device of this invention can be modified to provide various embodiments thereof.

DESCRIPTION OF THE PREFERRED EMBODIMENT

Figure 1:
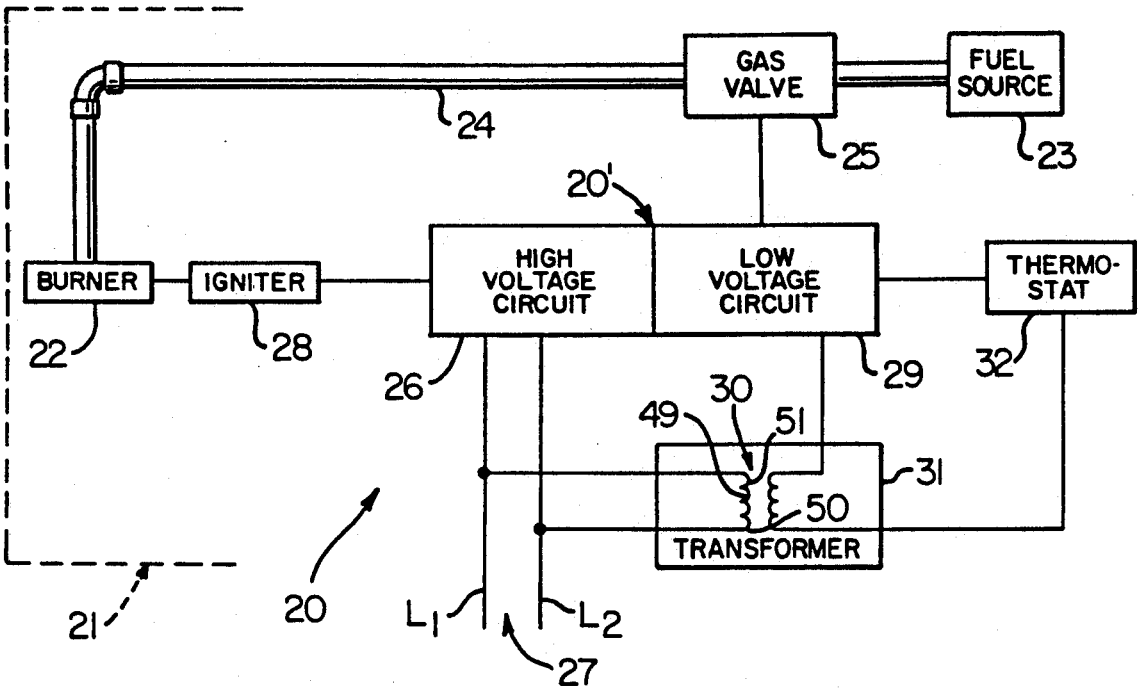
FIG. 1 is a schematic view, mainly in block diagram form, illustrating the hot surface ignition system of this invention.
Figure 2:
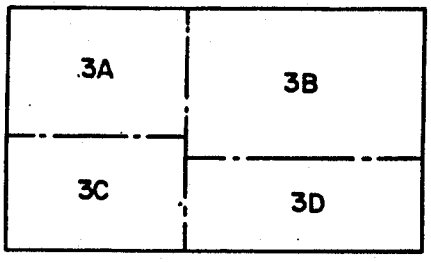
FIG. 2 is a schematic view illustrating how

While the various features of this invention are hereinafter illustrated and described as being particularly adapted to provide a hot surface ignition system for a gas furnace, it is to be understood that the various features of this invention can be utilized singly or in various combinations thereof to provide a hot surface ignition system for other apparatus as desired.

Therefore, this invention is not to be limited to only the embodiments illustrated in the drawings, because the drawings are merely utilized to illustrate one of the wide variety of uses of this invention.

Referring now to FIG. 1, the new hot surface ignition system of this invention is generally indicated by the reference numeral 20 and is utilized for a gas furnace that is generally indicated by the reference numeral 21 and has a main burner 22 therein that is adapted to be supplied fuel thereto from a fuel source 23 through a conduit means 24 when an electrically operated gas valve 25 is open in a manner hereinafter set forth, the gas valve 25 being part of the hot surface ignition system 20 that further comprises a high voltage circuit 26 being interconnected to a source 27 of high voltage AC current L1, L2, such as an 120 volt alternating current source. The high voltage circuit 26 has a hot surface igniter means 28 therein that is disposed in the path of gas issuing from the burner means 22. The hot surface ignition system 20 also comprises a low voltage circuit 29 for being connected to a source 30 of low voltage AC current, such as provided by a stepdown transformer 31 in a manner well known in the art, the low voltage circuit 29 having the gas valve 25 therein and having a thermostatic switch means 32 therein for controlling the energization of the low voltage circuit 29 with the low voltage AC current 30.

The system 20 includes a control device that is generally indicated by the reference numeral 20′ in FIG. 1, the control device 20′ comprising the high voltage circuit 26 and the low voltage circuit 29.

While the system 20 previously described is substantially the same as the system fully disclosed in the aforementioned U.S. Pat. No. to Geary, 4,711,628, and the U.S. Pat. No. to Geary, 4,643,668, whereby these two U.S. patents are being incorporated into this disclosure by this reference thereto, the system 20 of this invention includes a unique resetting means that is generally indicated by the reference numeral 100 in FIG. 3B and will be hereinafter described, the resetting means 100 being part of the control device 20′.

Figure 3A:
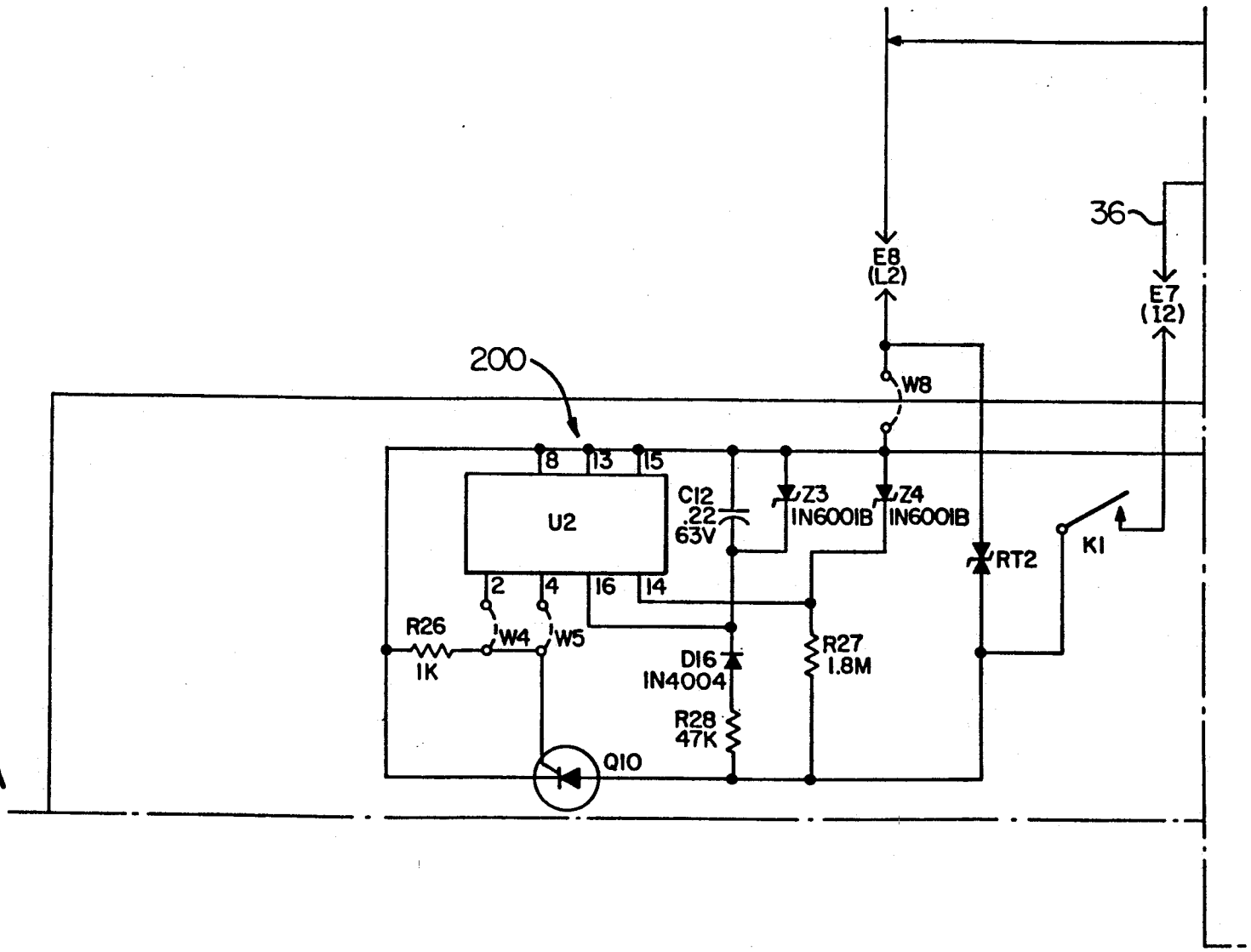
FIGS. 3A, 3B, 3C and 3D are to be positioned relative to each other in order to illustrate the entire wiring circuit for the hot surface ignition system and the control device of this invention.
Figure 3B:
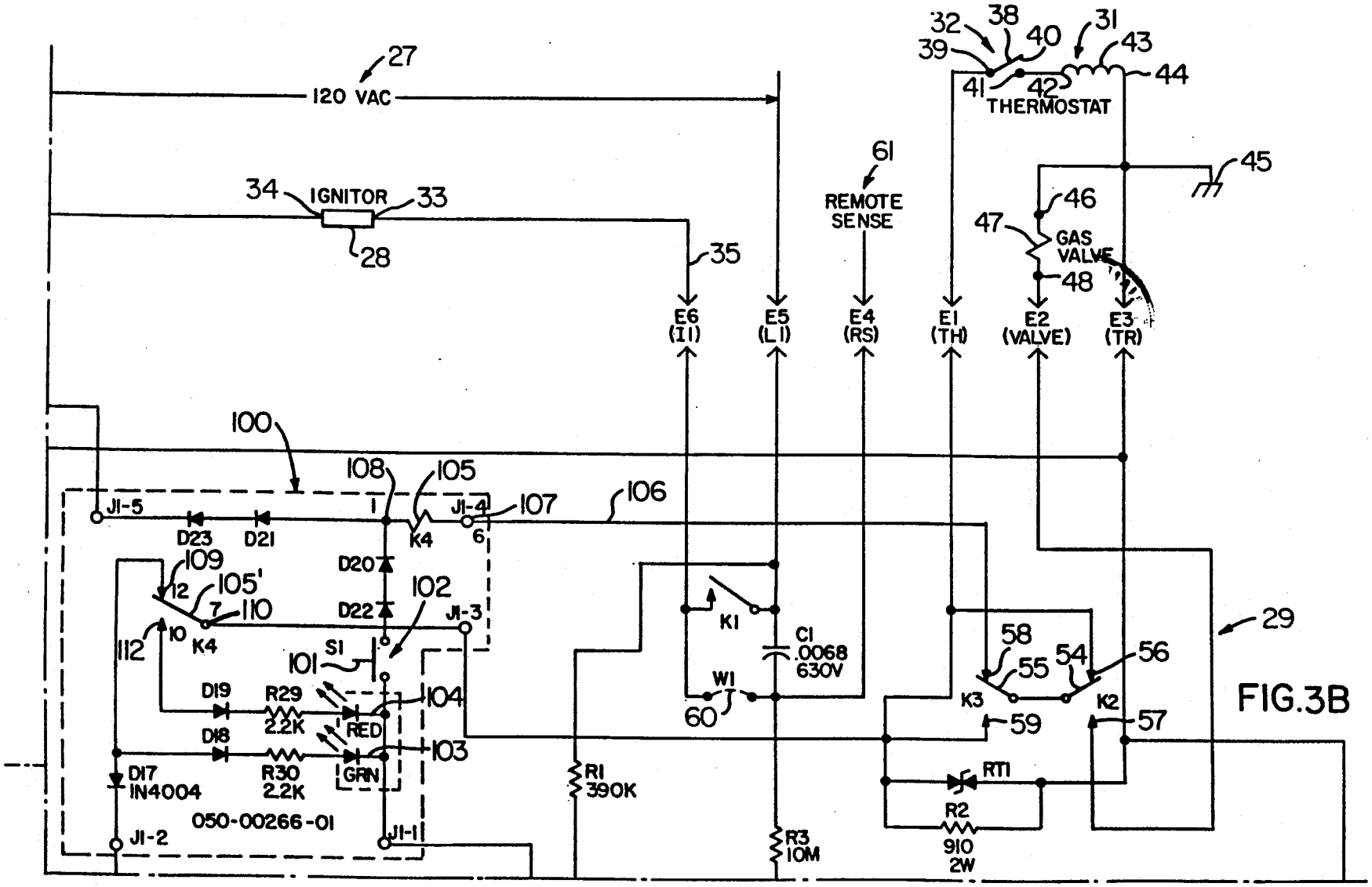

In addition, the system 20 and control device 20′ of this invention include a control section that is generally indicated by the reference numeral 200 in FIG. 3A for operating the igniter means 28 when the system 20 utilizes a source of higher voltage than the 120 VAC source 27 illustrated in FIG. 3B while utilizing the same igniter 28 that was to be utilized with the lower voltage source 27 of 120 VAC, the control section 200 being substantially the same as the control section that is set forth in the U.S. Pat. No. to Geary, 4,809,128 whereby this patent is also being incorporated into this disclosure by this reference thereto. Since the details of the parts and the operation of the control section 200 is fully set forth in the aforementioned U.S. Pat. No. to Geary, 4,809,128, and since the features of this invention do not require the control section 200 to be a part thereof, no further discussion of the control section will be provided in this disclosure.

In general, the system 20 when utilizing the 120 VAC source 27 will operate in such a manner that upon closure of the thermostat 32, and with the system 20 being set for a pre-purge operation, the system 20 will provide a 34 (or 17) second delay, after which a relay means is energized in a manner hereinafter described applying voltage to the igniter 28, which can comprise a silicon carbide heating element, for an additional 34(or 17) seconds at which point the gas valve 25 is opened allowing gas to issue from the burner means 22 and contact the hot surface of the igniter 28 which will ignite the gas. The resulting flame at the burner 22 is sensed by a flame rectification circuit in a manner hereinafter set forth forcing the gas valve 25 to remain open until the desired room temperature is reached and sensed by the thermostat 32 so that opening of the thermostat 32 will remove power from the system 20 allowing the gas valve 25 to close and thereby extinguish the flame at the burner 22.

However, in the above sequence, if ignition of the gas at the burner 22 has not been achieved during the initial attempt of the system 20 to so ignite the gas, which is a specified time period for the opening of the gas valve 25 by the system 20, the system 20, depending upon the option chosen, will shut down through a lockout thereof or will attempt to repeat the pre-purge/ignition cycle for up to two more times before locking out, depending upon how the system 20 is arranged. For example, see FIG. 4 wherein certain diodes are to be utilized for providing one ignition try, two ignition tries or three ignition tries both for a nonpre-purge arrangement or for a pre-purge arrangement.

The system 20, when in a locked out condition thereof that resulted because ignition did not occur at the end of the particular sequence of the one, two or three attempts selected, can only be reactivated by a reset button 101 of the reset means 100 of FIG. 3B being momentarily depressed to close an electrical switch means 102 in a manner hereinafter set forth, the reset means 100 having a green indicator lamp 103 which is lit during normal operation of the system 20 and a red indicator lamp 104 which will be lit to indicate a lockout condition requiring the pushbutton 101 to be momentarily depressed in order to reset the system 20 before the system 20 can again be activated to attempt ignition of the burner means 22.

This operation of the system 20 requiring the manual operation of the electrical switch means 102 is unique because the system as set forth in the aforementioned U.S. Pat. No. to Geary, 4,711,628, could be reset after a lockout condition by having a person open the thermostat 32 and then reclose the same so that voltage is first removed and then reapplied to the system 20 at which time the system 20 of U.S. Pat. No. to Geary, 4,711,628, will repeat the operating sequence until ignition or lockout occurs.

Thus, it can be seen that the resetting switch means 102 of this invention is disposed remote from the thermostat 32 and requires a person to locate the section 100 of the control device 20' of the system 20 in order to reset the same by depressing the button 101 if a lockout of the system 20 has occurred.

If the system 20 of this invention has been set for a nonpre-purge sequence, the system 20 would have initially, upon closing of the thermostat 32, provided a 34 second (or 17) second ignition period of energizing the igniter 28 followed by opening of the gas valve 25 for an attempt at gas combustion and, failing this, a 34 (or 17) second wait before another attempt is tried depending upon whether the system 20 has been set for one, two or three attempts as previously set forth. Failing ignition after the selected attempts have been tried, lockout will accur and thereby require operation of the switch means 102 by the push button 101 to reset the system 20 for further attempts at ignition thereby.

Thus, it can be seen that the options of the system 20 of this invention so far described have been to provide a pre-purge or nonpre-purge and one, two or three attempts at gas ignition before lockout occurs. Other options include local or remote flame sensing, a valve trial for ignition of 4, 6, 8 or 12 seconds, pre-purge/igniter times of 34 or 17 seconds, and optional igniter voltages of 120 VAC, 208/240 VAC, and 277 VAC.

As set forth in the previously mentioned U.S. Pat. Nos. to Geary, 4,711,628 and 4,643,668, the igniter 28 under the control of the system 20 remains fully powered up during approximately one-half of the time that the gas valve 25 is opened for ignition.

As illustrated in FIGS. 3A and 3B, the high voltage circuit 26 is interconnected to the high voltage source 27 by contact pins E5 and E8 being respectively interconnected to the power source lines L1 and L2 with line L1 being the hot line and line L2 being the neutral line as is well known in the art. The igniter 28 in FIGS. 3A and 3B has its opposed ends 33 and 34 interconnected by leads 35 and 36 respectively to contact pins E6 and E7.

The contact pins E7 and E8 of the system 20 are adapted to be interconnected to each other when one pair of normally open relay contact means K1 are closed. Likewise, contact pins E5 and E6 are adapted to be electrically interconnected together when the other pair of normally open relay contacts K1 are closed. The two pairs of relay contacts K1 are in the high voltage circuit 26 and are controlled by a relay coil K1 of FIG. 3D that is disposed in the low voltage circuit 29 so that when the coil K1 is energized, the relay contacts K1 are closed and the igniter 28 is placed across the power source 27 and when the relay coil K1 is deenergized, the contacts K1 return to the normally open condition thereof and disconnect the igniter 28 from the high voltage AC current 27.

Figure 3C:
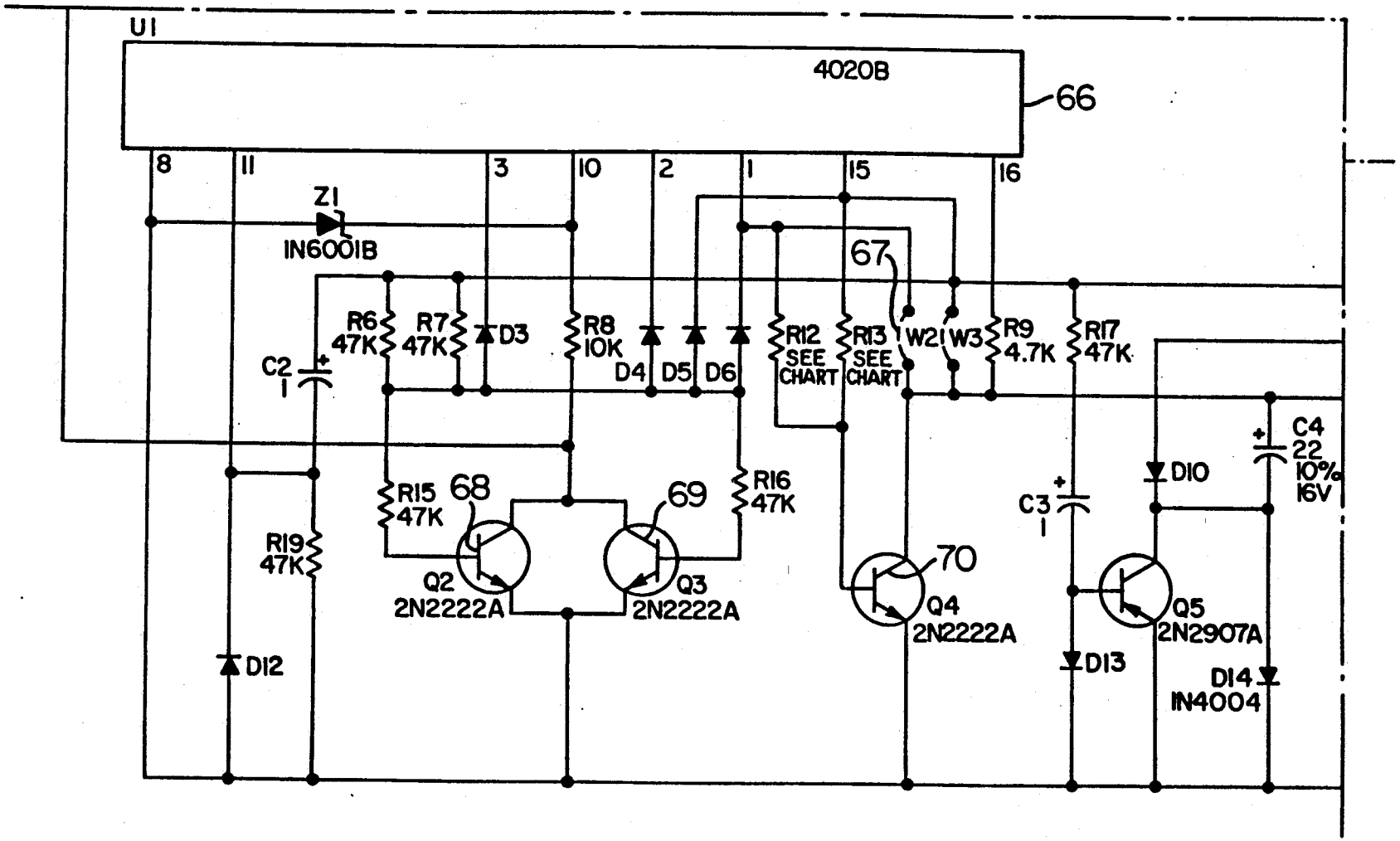
Figure 3D:
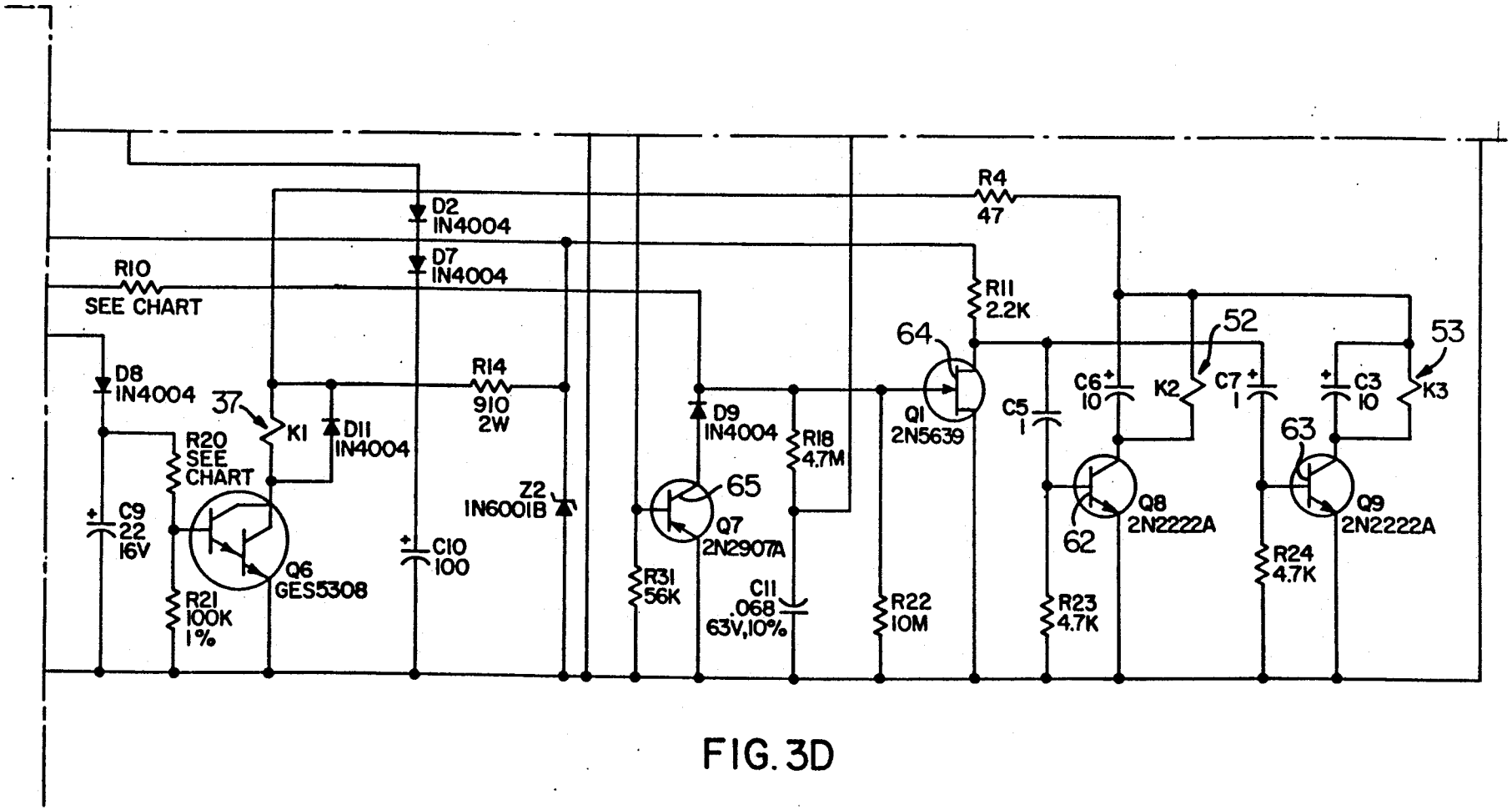

Thus, it can be seen that the relay contacts K1 and relay coil K1 comprise a relay means of the system 20 that is generally indicated by the reference numeral 37 in FIG. 3D.

The thermostat 32 of the ignition system 20 of this invention is shown as a switch blade 38 in FIG. 3B that has one end 39 thereof electrically interconnected to contact pin E1 and the other end 40 thereof adapted to be placed against a fixed contact 41 when the thermostat 32 senses that heat should be provided by the burner means 22 in a manner well known in the art, the contact 41 being electrically interconnected to one side 42 of a secondary coil 43 of the transformer 31 while the other side 44 of the secondary coil 43 is electrically interconnected to ground 45, to contact pin E3 and to one side 46 of an operating coil 47 of the gas valve 25 which has its other side 48 interconnected to the contact pin E2.

As illustrated in FIG. 1, the transformer 31 has a primary coil 49 that has its opposed ends 50 and 51 respectively electrically interconnected to the power source lead L1 and L2 whereby the transformer 31 provides the source of low voltage AC current 30, such as 24 volts AC in a manner well known in the art, for the low voltage circuit 29 of the system 20 that comprises substantially the entire remainder of the electrical circuit illustrated in FIGS. 3A, 3B, 3C and 3D and which will be hereinafter described.

The low voltage circuit 29 includes two other relay means that are respectively and generally indicated by the reference numerals 52 and 53 in FIG. 3D, the relay means 52 and 53 respectively having coil means K2 and K3 disposed in parallel in the low voltage circuit 29 and respectively having contact means K2 and K3, illustrated in FIG. 3B, that comprise movable contact means 54 and 55 and spaced apart stationary contact means 56, 57 and 58, 59. The movable contacts 54 and 55 of the contact means K2 and K3 are respectively normally disposed against the fixed contacts 56 and 58 when the coil means K2 and K3 are in a deenergized condition thereof and are moved and held against the fixed contacts 57 and 59 when the relay coil means K2 and K3 are energized in a manner hereinafter set forth.

In general, the operation of the hot surface ignition system 20 of this invention is that as long as the thermostat 32 is satisfied so that the movable contact 38 is in the open condition as illustrated in FIG. 3B, the first relay means 37 is in a deenergized condition so that the contacts K1 thereof are disposed in the open condition as illustrated in FIGS. 3A and 3B whereby the igniter 28 is disconnected from the high voltage AC current source 27. Under such conditions, the coil means K2 and K3 of the other relay means 52 and 53 are also in a deenergized condition so that the contact means K2 and K3 thereof are in the normal condition illustrated in FIG. 3B wherein the movable contacts 54 and 55 thereof are in contact with the fixed contacts 56 and 58.

However, upon the thermostat 32 demanding heat from the burner means 22, the switchblade or movable contact 38 of the thermostat is now disposed against the fixed contact 41 so that the transformer 31 now supplies the source 30 of low voltage AC current to the contact pins E2 and E3 and will, thus, cause the system 20 to either begin to immediately have the igniter 28 interconnected to the power source 27 by operating the first relay means 37 in a nonpurge operation of the system 20 or to have the igniter means 28 interconnected to the high voltage current 27 after a pre-purge time period has lapsed, such as after approximately 34 seconds. In any event, the system 20 is adapted to operate the igniter 28 for a certain period of time to heat up the same, such as for a period of 34 seconds, after which the gas valve 25 is operated by the energizing of the relay coils K2 and K3 in a manner hereinafter set forth to permit fuel to flow from the fuel source 23 to the burner 22 so that the same can issue from the burner 22 and be ignited by the hot surface of the igniter 28 in a manner well known in the art. Should the igniter 28 ignite the gas issuing from the burner 22, the igniter 28 then can act as a flame sensing means for the system 20 in a manner hereinafter set forth so that when the igniter 28 is to be utilized as the flame sensing means for the system 20, the low voltage circuit 29 has a jumper 60 of FIG. 3B disposed therein. However, if the burner means 22 comprises a plurality of burners disposed in side-by-side relation so that the igniter 28 is being utilized to merely ignite one of the burners which in turn then will ignite the next burner and so on until the last burner is ignited, a remote flame sensing means can be utilized and the same is generally indicated by the reference numeral 61 in FIG. 3B and is adapted to be interconnected to contact pin E4. When the remote flame sense means 61 is utilized, the jumper 60 of the circuit 29 is removed so that the igniter 28 will not act as the flame sensing means under this condition.

Once flame sensing has been detected by either the igniter 28 or the remote sense means 61, such flame sensing means maintains the energization of the relay coils K2 and K3 so that the movable contacts 54 and 55 thereof are maintained against the fixed contacts 57 and 59, so that the gas valve 25 will be in an open condition to continuously supply fuel to the burner means 22.

However, once the thermostat 32 is again satisfied, the movable contact 38 thereof is moved away from the fixed contact 41 to disconnect the low voltage alternating current from the low voltage circuit 29 so that the relay coils K2 and K3 are deenergized and cause the contacts 54 and 55 thereof to move away from the fixed contacts 57 and 59 and against fixed contacts 56 and 58 whereby the electrically operated gas valve 25 now closes and terminates the flow of fuel from the source 23 to the burner means 22 and the system 20 is now in a condition to again ignite the burner means 22 and operate the same in the manner previously described once the thermostat 32 again demands heat in the manner previously set forth.

The details of the system 20 for operating in the above manner and in the manner hereinafter set forth will now be described.

As previously stated, when the igniter 28 heats up to ignition temperature, such as a temperature of about 3000° F., the gas that issues from the burner means 22 and sprays over the hot surface of the igniter 28 and, if ignition occurs, the electronic circuitry of the system 20 will sense that combustion has occurred and will maintain the gas valve 25 in its open condition. However, if ignition does not occur, the low voltage circuit 29 will close the gas valve 25 and then go through another trial ignition period and depending upon how the system 20 is set up, up to three trials for ignition can be provided by the system 20 before the system 20 will go into a lockout condition that will no longer allow trials for ignition and the only way that the control system 20 can be taken out of lockout is for the push button 101 to be depressed so that switch 102 will reset the control system 20 in a manner hereinafter set forth and allow it to try again for ignition.

As illustrated in FIG. 3D, the low voltage circuit 29 is provided with transistors Q8 and Q9 that are respectively relay driver transistors for the relay coil means K2 and K3. An AC signal into the base 62 of the transistor Q8 and into the base 63 of the transistor Q9 will energize the respective relay coil means K2 and K3 of the relays 52 and 53 and thereby pull in the relays 52 and 53 to move the movable contacts 55 and 56 thereof downwardly in FIG. 3B to be against the lower fixed contacts 57 and 59. If the signal to the bases 62 and 63 of the transistors Q8 and Q9 become DC, capacitors C5 and C7 of the low voltage circuit 29 will not pass the DC signals. The portion of the low voltage circuit 29 that drives the transistors Q8 and Q9 comprises the combination of a field effect transistor Q1 and a PNP transistor Q7.

The properties of the field effect transistor Q1 is that with no voltage on its gate 64 and since the field effect transistor Q1 is an NPN depletion mode field effect transistor, the field effect transistor Q1 is almost like a short circuit in that it has an effective resistance of about 60 ohms. Thus, if a DC signal is applied to the drain through a resistor, most of the voltage will be dropped across a series resistor and very little voltage will be across the field effect transistor Q1. If, however, a negative voltage is put into the gate 64 of the field effect transistor Q1, the field effect transistor Q1 will become a very high resistance device and most of the voltage would be developed across the field effect transistor Q1 from drain to ground. In this manner, if the voltage to the gate 64 of the field effect transistor Q1 periodically goes from 0 to some negative voltage then back to 0 and then to some negative voltage at a cycling rate, the output from the field effect transistor Q1 would follow this and go up down, up down, etc., which produces an AC drive signal that is allowed to go through capacitors C5 and C7 of the circuit 29 to activate the transistors Q8 and Q9 of the circuit and turn the relay means 52 and 53 to their on condition by energizing the relay coil means K2 and K3.

The PNP transistor Q7, which is interconnected to the gate 64 of the field effect transistor Q1, has a 60 cycle signal applied to its base by the circuit 29 in a manner hereinafter set forth whereby the PNP transistor Q7 is turning on and off at a 60 cycle rate. If there is a negative voltage applied to the gate 64 of the field effect transistor Q1, this negative voltage is also applied to the collector 65 of the transistor Q7 by the low voltage circuit 29 in a manner hereinafter set forth. Since the transistor Q7 is turning on and off at a 60 cycle rate, it follows that the voltage at the gate 64 of the field effect transistor Q1 is also going from 0 to some negative value at a 60 cycle rate. As long as there is a negative input voltage coming into the gate 64 of the transistor Q1 and the transistor Q7 is turning on and off at a 60 cycle rate, the relay driver transistors Q8 and Q9 are getting a signal that will pull the relays 52 and 53 in.

Thus, it can be seen that a negative voltage must be imposed on the gate 64 of the field effect transistor Q1 in order to have the relays 52 and 53 pull in. The system 20 provides two sources for this negative voltage, one of which is from a flame rectification sense signal. For example, when the igniter 28 is acting as a flame sense means and the jumper 60 is in the circuit 29, it will sense a flame at the burner means 22 because of the charging going on between capacitors C1, FIG. 3B, and C11, FIG. 3D. Since the capacitor C1 will charge more net negative than it will charge net positive, which is how flame rectification operates in a manner well known in the art, this negative voltage will be transferred through resistor R3 to the capacitor C11 and, therefore, a negative to positive voltage will develop across the capacitor C11. This negative voltage is then applied to the gate 64 of the field effect transistor Q1 through resistor R18 so that as long as there is a flame sense, there is a negative voltage applied to the gate 64 of the field effect transistor Q1 and the relays 52 and 53 will come in and stay in.

However, in order to have the relays 52 and 53 close in the first place before ignition occurs at the burner means 22, the relays 52 and 53 must first close in order to open the gas valve 25 and, therefore, the system 29 will apply a negative voltage to the gate 64 of the field effect transistor Q1 by another source thereof than the flame rectification that was previously described.

Thus, with the relays K2 and K3 deenergized and the thermostat 32 initially closing the movable contact 38 against the fixed contact 41 so as to start the operation of the system 20 to supply heat by the burner means 22, a low voltage AC current signal is passed from the closed thermostat 32 through the closed contacts 56, 64 and closed contacts 55, 58 of the deenergized relay means 52 and 53 through a coil K4 of a latching relay 105 of the reset means 100 and a resistor R8 into a pin 10 of a conventional 4020B divide by 14 electronic counter that is generally indicated by the reference numeral 66 in FIG. 3C. Thus, pin 10 is a clock input to the counter 66 and pins 1, 2, and 3 of the counter 66 are the outputs thereof. The input signal to the counter 66 causes the counters of the clock circuit therein to begin to divide the frequency of the input signal in a manner well known in the art so that the counter 66 will give an output signal on pin 1 after approximately 34 seconds and then after another approximately 34 seconds it will cause the output on the pin 1 to go back to 0 and will continue to do this every 34 seconds. Thus, the voltage on the pin 1 will switch from 0 to approximately 11 volts for 34 seconds and then go back to 0 for 34 seconds and then back to 11 volts in a 34 second cycling rate in a manner well known in the art.

In a prepurge operation of the system 20 of this invention, as illustrated by the table of FIG. 4, the resistors R9, R12 and transistor Q4 are removed from the circuit 29 and the jumper 67 is included in the system 29. However, the jumper 67 is removed and the resistors R9 and R12 and transistor Q4 are included in the circuit 29 when the circuit 29 is to operate in a nonpre-purge manner as will be apparent hereinafter.

Thus, after the input signal is applied to the pin 10 of the counter 66 and after approximately 34 seconds, the voltage at the output pin 1 goes to a positive voltage of approximately 11 volts and it charges a capacitor C4 through a diode D14 and it charges another capacitor C9, FIG. 3D, through a diode D8. When a potential is created across the capacitor C9, the capacitor C9 turns on a transistor Q6 which, in turn, energizes the relay coil K1 of the relay means 37 and thereby closes the relay contacts K1 to place the igniter 28 across the high voltage AC current 27. In this manner, the igniter 28 begins its heat up cycle. The voltage on the output pin 1 of the counter 66 will remain there for approximately 34 seconds so, therefore, the transistor Q6 is on for approximately 34 seconds whereby the igniter 28 has power applied to it for approximately 34 seconds. At the end of this 34 seconds, the voltage on the counter output pin 1 drops back down to ground potential and the charge on capacitor C9 begins to bleed off through a resistor R20. This bleed off period is designed to be approximately one-half of the desired on time for the gas valve 25 for a trial ignition period. In other words, if it is desired to leave the gas valve 25 on for approximately 4 seconds to try for ignition, it is desired to leave the igniter 28 on for the first approximately 2 seconds of that 4 second period so that a full powered up condition will be provided for ignition. Thus, if it is desired to have an on time of approximately 12 seconds for the gas valve 25, then it is desired to leave the igniter 28 on for an additional 6 seconds beyond the time that the output pin 1 goes back to ground potential. In this manner, during halfway through the time period for the trial for ignition, the igniter 28 is at full power and there will be no cooling down of the igniter 28 during the first half of the on time of the gas valve 25 and this is a result of the time means provided by the combination of the capacitor C9 and resistance R20. It can be seen from FIG. 4 that by selecting various values for the resistance R20, various valve on times can be provided for the gas valve 25.

Also, the capacitor C4 has been charged up during the on time of the output pin 1 so that when the voltage on the pin 1 drops to ground potential, there is no longer any potential trying to keep capacitor C4 charged up. The capacitor C4 cannot discharge through the diode D14 to ground because of the polarity of the diode D14, but it can discharge through a diode D10 and through a resistance R10 into the gate 64 of the field effect transistor Q1 and this signal from the discharge of the capacitor C4 through the diode D10 and the resistance R10 is a negative voltage. Since a negative voltage is now at the gate 64 of the field effect transistor Q1, it causes the field effect transistor Q1 to want to go to a high resistance state but the PNP transistor Q7 dumps this to ground at a 60 cycle rate so, therefore, the output from the field effect transistor drain to ground is fed into the bases 62 and 63 of the transistors Q8 and Q9 as an AC signal. This AC signal is coupled through the capacitors C5 and C7 and allows the transistors Q8 and Q9 to pull in their respective relays 52 and 53. The pull in of the relays 52 and 53 causes the movable contacts 54 and 55 to move against the fixed contacts 57 and 59 and thereby interconnect the contact pin E1 with the contact pin E2 so that the coil 47 of the gas valve 25 is energized to open the gas valve 25. In this manner, gas is now pushed through the burner means 22 across the hot surface of the igniter 28 and if combustion occurs when the igniter 28 drops out because the contacts K1 now open when the capacitor C9 is completely discharged so as to terminate the operation of the transistor Q6 and permit the relay 37 to have the coil K1 thereof deenergized, the igniter 28 will now be able to then act as a sensor and flame rectification will occur. This flame rectification will reinforce the negative voltage that is being put into the gate 64 of the field effect transistor Q1 and keep the field effect transistor Q1 turned on. Therefore, if the field effect transistor Q1 is continued to be supplied with the negative voltage through the flame rectification, the transistors Q8 and Q9 will still hold the relays 52 and 53 in their pulled in condition and there will still be a continuation flow of gas through the energized gas valve 25 and combustion will have been proved.

Since the igniter 28 is being energized for the first half cycle of the trial period for ignition, flame sense cannot be provided by the igniter 28 for the first half of this trial period and this is strictly to ensure that a hot surface will be provided by the igniter 28 for the gas to ignite on. For the remaining half cycle of this gas on period, flame sensing is provided by the igniter 28 and a minimum of about 1 second is provided for this flame sensing which is a sufficient time period for the system 20 to operate properly. Therefore, if flame rectification is not provided during this time period, the charge from the capacitor C4 finally bleeds off to a point where the field effect transistor Q1 can no longer couple this AC signal to the transistors Q8 and Q9 and, therefore, the relays 52 and 53 drop out so that the movable contacts 54 and 55 thereof move away from the fixed contacts 57 and 59 to terminate the operation of the gas valve 25. Also, the movable contacts 54 and 55 of the deenergized relays 52 and 53 move against the fixed contacts 56 and 58 under this condition so that they return to their normally closed condition for reapplying the clock signal to the counter 66. At the time when the relays 52 and 53 were pulled in for the previously described trial ignition attempt, there was no clock signal being applied to the input pin 10 of the counter 66 so that the system 20 went from digital timing when the clock signal was applied to the counter 66 to analog timing when the relays 52 and 53 were pulled in. Therefore, if ignition is not accomplished, the relays 52 and 53 go back to the normally closed position and will reapply the clock signal to the pin 10 of the counter 66 as previously set forth. If only the output pin 1 of the counter 66 has been connected to transistors Q2 and Q3 when the pin 1 came on with a positive voltage, it would have turned these two transistors Q2 and Q3 on and dumped the clock signal to ground so that there would have been only one trial period for ignition. However, in the circuit illustrated in the drawings, there is an output from the pin 2, an output from the pin 1 and an output from the pin 3 respectively through diodes D4, D6 and D3 which are all coupled into the bases 68 and 69 of the transistors Q2 and Q3. The transistors Q2 and Q3 are a redundant pair so that if one transistor should open or short, the other one is still in effect and will control the clock signal. Whenever there is a voltage into the base 68 or 69 of either one of the transistors Q2 and Q3, they dump the clock signal and the counter 66 can no longer count and it stays in the state that it was in at that time and this is known as a lockout. From that time on there is no longer a progress in the circuit because there is no clock signal available to do anything. Therefore, it can be seen that how many trials for ignition are provided for the system 20 will depend on which diode was inserted into the low voltage circuit 29 thereof and this is made clear by the option table of FIG. 4.

When it is desired for a nonpre-purge operation to be provided by the system 20 of this invention, the resistors R9 and R12 and the transistor Q4 are included in the system 20 as illustrated and the jumper 67 thereof is removed. Thus, when the thermostat 32 closes, there is no voltage as usual coming out of the output pin 1 of the counter 66. However, with the transistor Q4 in the circuit 29, the voltage at the collector 70 of the transistor Q4 is already high and, therefore, the capacitor C9 will immediately charge up and turn on the igniter 28. Thus, it can be seen that the igniter 28 turns on immediately without a 34 second wait as in the pre-purge operation previously described. If ignition does not occur at the end of this period, there is a waiting period of approximately 34 seconds before the system 20 again tries for ignition. Therefore, all that the nonpre-purge system has done is to shift the 34 second period.

Thus, it can be seen that with a pre-purge operation of the system 20, there is a wait for approximately 34 seconds before the igniter 28 comes on and that if ignition is not provided, the system 20 goes into a pre-purge mode again for an additional 34 seconds and then ignition is attempted again. With a nonpre-purge version of the system 20, the igniter 28 is immediately turned on and if ignition is not obtained, there is a wait for approximately 34 seconds and then the system again tries for ignition.

The resetting means 100 of this invention includes the coil 105 of the latching relay K4 that has a switch blade 105', the coil 105 being disposed in a line 106 of the system 20 so that the coil 105 is polarized in such a manner, when a terminal 107 is positive with respect to a terminal 108 that the relay K4 is energized to interrupt the contact continuity between contact points 109 and 110 by moving the switch blade 105' away from the contact 109 and into contact with a contact 112. This breaks the circuit consisting of the three series connected diodes D17, D2 and D7 that supply DC voltage to the remainder of the control circuit whereby all voltage is removed from the control means of the system 20. Since the clock signal at pin 10 of the clock 66 is also supplied through the relay coil 105 by the line 106, an open coil 105 would prevent the control from functioning. This polarized voltage is obtained when transistors Q2 and Q3 conduct through the redundant diodes D21 and D23. This conduction of transistors Q2 and Q3 is caused by a lockout signal which shorts the clock signal and energizes the latching relay K4 which removes DC voltage as previously stated and additionally removes voltage from the green LED indicator 103 which is normally on whenever the thermostat 32 is closed. Contacts 109 and 110 are now opened but contacts 110 and 112 are now closed which causes the red LED indicator 104 to light indicating a lockout condition has occurred. At this time, the system 20 is in a lockout condition with the relays K1, K2 and K3 deenergized so that gas flow to the burner 22 has been terminated.

However, by a person depressing the switch button 101 to close the switch 102, a common of the circuit 20 is interconnected through redundant diodes D20 and D22 to the terminal 108 of the relay coil 105 which allows polarized current to pass through the coil 105 (negative at terminal 107 and positive at terminal 108) causing the coil 105 to move the switch blade 105' to close the contact 110 against the contact 109 and thereby resupplying DC voltage to the control and removing the control from lockout so as to restore normal operation thereof. Thus, if the thermostat 32 is closed at this time of resetting the system 20, the system 20 will again attempt ignition of the burner in the above manner.

The rest of the circuit means 29 of this invention as illustrated in FIGS. 3A-3D need not be further described in detail because the various parts thereof and operation thereof are obvious to a person skilled in the art and it can be seen that unless otherwise specified in such FIGS. 3A-3D, all diodes therein are IN4148, the value of R12 or R13 is 47K, all capacitance values are in microfarads, 50V, 20%, and all resistant values are in ohms, 0.25W, 5%.

From the above description of the hot surface ignition system 20 of this invention, it can be seen that the contact means K2 and K3 of the relay means 52 and 53 are both in the normally closed condition illustrated in FIG. 3B wherein the movable contacts 54 and 55 thereof are disposed against the fixed contacts 56 and 58 when the thermostat 32 is in an open condition so that when the thermostat 32 moves to a closed condition, the relay contacts K2 and K3 can send a signal to the counter 66 through line 106. However, if the relay contacts K2 or K3 are in some other position, i.e., the relay contacts K2 or K3 are already energized when the voltage input is provided by the thermostat 32, the system 20 will never have the counter 66 counting the 60 cycles so that an ignition attempt will not happen because a dead circuit is provided and the gas valve 25 cannot be open because one of the relays 52 and 53 must be in a pulled in condition and that prevents the signal from the closing thermostat 32 to pass to the counter 66. Therefore, it can be seen that the counter 66 cannot begin its count because both relays 52 and 53 must be in a deenergized condition thereof at the time the thermostat 32 closes.

If for some reason the capacitor C5 or the capacitor C7 is shorted, which would put a DC voltage on that transistor Q8 or the transistor Q9 and pull in either the relay 52 or the relay 53, there is a failure of the system 20 but that failure will not permit the counter 66 to begin its counting and therefore will not allow the other relay K2 or K3 to be pulled in and thereby operate the gas valve 25 because the system 20 requires both relays 52 and 53 to be pulled in in order to operate the gas valve 25.

From the above, it can be seen that the system 20 operates in a unique manner.

In particular, when the thermostat 32 initially closes, a low voltage AC current is passed through the relay contacts K2 and K3 as the same are in the condition illustrated in FIG. 3B so that a signal is provided at the input pin 10 of the counter 66 and the counter 66 begins to count. In the pre-purge operation of the system 20, approximately 34 seconds passes before a positive voltage appears on the output pin 1 of the counter 66 and this causes a charging up of the capacitors C4 and C9. When capacitor C9 has a potential across it, capacitor C9 turns on the transistor Q6 which, in turn, energizes the relay coil K1 of the relay means 37 to cause its relay contacts K1 to close and thereby place the igniter 28 across the high voltage AC current 27 to heat up the igniter 28 to an ignition temperature thereof. After approximately 34 seconds, the counter 66 causes the voltage on the output pin 1 to drop to ground potential whereby the charged capacitor C9 now begins to discharge and thereby maintain the relay coil K1 of the relay means 37 energized for the first half of the time that the gas valve 25 will be operating for the first ignition attempt. At this time, the charged capacitor C4 also discharges through the diode D8 and the resistance R10 into the gate 64 of the field effect transistor Q1 which through the cooperation of the transistor Q7 in the manner previously described causes the field effect transistor Q1 to develop an AC signal that is coupled through the capacitors C5 and C7 and allows the transistors Q8 and Q9 to pull in their respective relays 52 and 53 by energizing the relay coils K2 and K3 thereof whereby the relay contacts K2 and K3 are operated so that the movable contacts 54 and 55 move away from the fixed contacts 56 and 58 and are placed in contact with the fixed contacts 57 and 59. In this condition of the pulled in relays 52 and 53, the signal from the closed thermostat 32 now passes from the contact pin E1 to the contact pin E2 through the closed contacts 55, 59 and 56, 57 to energize the coil 46 of the gas valve 25 and thereby cause the gas valve 25 to direct fuel across the heated igniter 28.

If the igniter 28 ignites the fuel and is being used as the flame sense for the system 20, the capacitor C9 is finally dissipated and thereby causes the transistor Q6 to deenergize the coil K1 of the relay 37 so that the relay contacts K1 open and thereby disconnect the igniter 28 from the high voltage AC current 27. However, because the igniter 28, through flame rectification is interconnected into the low voltage circuit 29 by the jumper 60, the voltage developed between the capacitors C1 and C11 is negative and is imposed upon the gate 64 of the transistor Q1 as previously described so that even though the capacitor C4 has the charge thereon now dissipated, the field effect transistor Q1 continues to supply an alternating current signal to the bases 62 and 63 of the transistors Q8 and Q9 to maintain the relay coils K2 and K3 of the relay means 52 and 53 energized so that the contacts 54 and 55 remain against the fixed contact 57 and 59 and the gas valve 25 continues to supply gas to the burner 22 until the thermostat 32 opens. The opening of the thermostat 32 removes the low voltage current from the low voltage circuit 29 and thereby the coils K2 and K3 of the relays 52 and 53 are deenergized and cause the relay contacts K2 and K3 thereof to have the movable contacts 54 and 55 moved away from the fixed contacts 57 and 59 to deenergize the gas valve 25 and be placed against the fixed contacts 56 and 58 so that the system 20 is now ready to again operate the counter 66 for ignition purposes when the thermostat 32 subsequently closes, the deenergizing of the gas valve 25 thereby terminating the flow of fuel to the burner 22.

As previously stated, should ignition not occur during the time the capacitor C4 is discharging, then the counter 66, depending upon how many ignition attempts are provided by the system 20 as indicated by the chart in FIG. 4, will cause additional attempts until the transistors Q2 and Q3 provide a lockout which can only be corrected by momentarily closing and opening the switch means 102 by the push button 101 in the manner previously described.

The above described operation of the hot surface ignition system 20 of this invention can occur without a pre-purge time period by removing the jumper 67 and utilizing the transistor Q4 and the resistances R9 and R12 so that once a signal is provided on the input pin 10 of the counter 66 by the thermostat 32 initially closing, the transistor Q6 if immediately turned on to energize the relay coil K1 of the relay 37 so as to immediately place the igniter 28 across the high voltage AC current 27 whereby the system 20 then functions in the same manner as the pre-purge operation previously described.

Therefore, it can be seen that this invention not only provides a new hot surface ignition system and a new control device for a gas furnace and the like, but also this invention provides new methods of making a hot surface ignition system and a new control device for a gas furnace or the like.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a method of making a hot surface ignition system for a gas furnace or the like, said method comprising the steps of forming said system to comprise a burner means, a settable thermostat means, an electrically operable gas valve, control means, and an electrically operable hot surface igniter means disposed so as to be in the path of gas issuing from said burner means that is adapted to be fed said gas from a source thereof through said gas valve when said control means has been activated by said thermostat means to operate said igniter means and said gas valve in a certain sequence, forming said control means to have lockout means for deactivating said system should ignition of said gas issuing from said burner means not take place by the end of said certain sequence, forming said control means to have resetting means for causing said control means to be reactivated to be adapted to repeat said certain sequence of said system when said resetting means is activated, forming said control means to have means for selecting said certain sequence to have one or more attempts of said control means to ignite said gas at said burner means before said lockout means can deactivate said system, forming said means for selecting said certain sequence to comprise a clock means having an input means, and forming said control means to have an electrical line means for interconnecting said thermostat means to said input means of said clock means, the improvement comprising the steps of forming said resetting means to comprise a manually operated electrical switch means that is remote from said thermostat means and which must be manually moved to a certain position thereof to activate said resetting means, forming said resetting means to comprise a latching relay means having a coil means disposed in said line means, and forming said control means to cause said coil means of said relay means to be operated to one condition thereof that deactivates said system when ignition of said gas issuing from said burner means does not take place at the end of said certain sequence.

2. A method as set forth in claim 1 and including the step of operatively interconnecting said manually operated electrical switch means to said relay means to cause said coil means of said relay means to be operated to another condition thereof that activates said system for permitting said system to attempt to ignite gas issuing from said burner means when said switch means is moved to said certain position thereof after said coil means of said relay means has been operated to said one condition thereof.

3. A method as set forth in claim 2 and including the step of forming said resetting means to have indicator means for indicating which condition said coil means of said relay means is in at that particular time.

4. A method as set forth in claim 3 and including the step of forming said indicator means to comprise two lamp means one of which is operated by said control means when said coil means of said relay means is in said one condition thereof and the other of which is operated by said control means when said coil means of said relay means is in said other condition thereof.

5. A method as set forth in claim 1 and including the step of forming said switch means to comprise a momentarily operated switch means.

6. A method as set forth in claim 5 and including the step of forming said switch means to comprise a push button means for momentarily operating said switch means.

* * * * *